US006694720B2

(12) United States Patent
Driggars et al.

(10) Patent No.: US 6,694,720 B2
(45) Date of Patent: Feb. 24, 2004

(54) METHOD AND APPARATUS FOR FORMING A COTTON/RAYON BLENDED YARN

(75) Inventors: Sonny B. Driggars, Advance, NC (US); Carroll D. Lineberry, Galax, VA (US); Steve B. Brooks, Clemmons, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/292,110

(22) Filed: Nov. 12, 2002

(65) Prior Publication Data

US 2003/0115851 A1 Jun. 26, 2003

Related U.S. Application Data

(62) Division of application No. 09/758,151, filed on Jan. 11, 2001, now Pat. No. 6,477,826.

(51) Int. Cl.[7] ..... D01H 4/08; D02G 3/04

(52) U.S. Cl. ..... 57/408; 57/256; 57/309

(58) Field of Search ..... 57/256, 309, 400–417

(56) References Cited

U.S. PATENT DOCUMENTS

| | | | | | |
|---|---|---|---|---|---|
| 4,144,702 | A | | 3/1979 | Pittman | 57/58.89 |
| 4,144,703 | A | | 3/1979 | Ingham, Jr. | 57/58.89 |
| 4,160,359 | A | | 7/1979 | Frentress | 57/58.89 |
| 4,302,925 | A | | 12/1981 | Edagawa et al. | 57/58.95 |
| 4,384,450 | A | * | 5/1983 | Sawyer | 57/254 |
| 4,466,237 | A | * | 8/1984 | Sawyer | 57/254 |
| 4,698,956 | A | | 10/1987 | Clarke et al. | 57/2 |
| 4,845,946 | A | * | 7/1989 | Deussen | 57/409 |
| 5,265,406 | A | * | 11/1993 | Hofmann et al. | 57/417 |
| 5,330,538 | A | * | 7/1994 | Teague et al. | 8/114.6 |
| 5,802,826 | A | * | 9/1998 | Sawhney et al. | 57/5 |
| 6,023,925 | A | * | 2/2000 | Schnegg et al. | 57/1 R |
| 6,067,785 | A | * | 5/2000 | Russell et al. | 57/400 |
| 6,082,143 | A | | 7/2000 | Noonkester et al. | 66/151 |
| 6,269,623 | B1 | * | 8/2001 | Phoa et al. | 57/417 |

FOREIGN PATENT DOCUMENTS

DE 3934166 C2 * 6/1994 ..... D01H/4/40

OTHER PUBLICATIONS

A Physically–Based Model Fabric Drape website printout; Muthu Govindaraj; Apr. 1996.
Xen; Ge–Ray Fabrics; date unknown.
Open–End Spinning for Alamac Apparel Knits; Kris Swamy, Jun. 20, 1985.
Knit Fabrics from Open End Yarns A Study to Develop a Softer Hand; Cotton Incorporated; available as of filing date.
Rotor Spinning Technology; Helmut Deussen; pp. 25–28; 1993.
Rotor Spinning; Günter Trommer; 1995.

* cited by examiner

*Primary Examiner*—John J. Calvert
*Assistant Examiner*—Shaun R Hurley
(74) *Attorney, Agent, or Firm*—Womble Carlyle Sandridge & Rice, PLLC

(57) ABSTRACT

An apparatus for forming a cotton/rayon blended yarn. The apparatus includes a supply of cotton fibers and a supply of rayon fibers. A blending operation line blends the cotton fibers and the rayon fibers. The fibers are then spun in an open end spinning turbine having a twist multiple of less than about 3.7 at a rotor speed of less than about 112,000 RPM. A roughing navel downstream from the open and spinning turbine distressing the surface of the cotton/rayon blended yarn to further improve the hand of yarn. The yarn is then knitted or woven into fabric and finished. The resulting fabric, and apparel made therefrom, has the advantage of having a particularly soft and luxurious hand, particularly compared to fabric knit from 100% cotton yarn.

16 Claims, 3 Drawing Sheets

METHOD AND APPARATUS FOR FORMING A COTTON/RAYON BLENDED YARN

This application is filed pursuant to 37 C.F.R. § 1.53(b) and is a Divisional of application Ser. No. 09/758,151, filed Jan. 11, 2001 now U.S. Pat. No. 6,477,826.

BACKGROUND OF THE INVENTION (1) Field of the Invention

The present invention relates generally to open end spinning and, more particularly, to an apparatus and method for economically producing a cotton/rayon blended yarn, which provides an improved hand and drape in knitted fabrics and articles of apparel sewn therefrom, particularly after washing the article of apparel.

(2) Description of the Prior Art

Many fabrics for articles of apparel, such as Tee-shirts, are made of 100% ring spun cotton yarn. Ring spun yarn when knitted into fabric produces a relatively soft fabric with a good "hand," which is highly desirable from a consumer point of view. The soft hand associated with fabric made from ring spun yarn is the result of the relative "hairiness" of the surface of ring spun yarn. Upon magnification, it can be seen that ring spun yarn has fibers that protrude from the yarn surface. These protruding fibers are the result of the "fibrillation" of the yarn, that is, after the fibers are spun into yarn, some fibers, particularly at the surface, break apart and the broken ends protrude from the surface of the fiber. These protruding ends give fabric knit from ring spun yarn a softer hand.

Another widely used spinning process is open end spinning. Open end spun yarn, is significantly less expensive to produce than yarn produced via a ring spinning process. This is because the ring spinning process takes substantially more time to produce the same amount of yarn as the open end rotor spinning process. A significant disadvantage associated with fabric knitted from open end spun yarn is that the fabric has a harsher hand than fabric knitted from ring spun yarn. This is because there is less fibrillation associated with open end rotor yarn.

A significant economic market exists for articles of apparel, such as Tee-shirts, that are printed with images and/or embellished with decorative designs. There are problems, however, associated with printing or embellishing apparel made from ring spun cotton yarn. As a result of fibrillation, which contributes to the softness of fabric made from ring spun yarn, printed images tend to appear less bright and vivid because of the protrusion of fibers through the printed image over time due to washing and wear. For example, the color black printed on a white Tee-shirt may appear gray in color over time because of the fibrillation of the white fibers and their protrusion through the black portion of the printed image.

Cotton is a fiber that is commonly used to produce ring or open end spun yarn from which fabric is knit and articles of apparel, such as Tee-shirts, are made. Fabric knitted from 100% cotton yarn has the desirable characteristic of being made from all natural fibers, as opposed to synthetic fibers, such as polyester, which is desirable from a consumer point of view. Another advantage of cotton is that it is a relatively inexpensive fiber.

Rayon is a fiber well known in the textile industry and is used widely in the manufacture of apparel. Rayon is a man made fiber that is produced by forcing a cellulose solution that is made from wood pulp through fine spinnerets and solidifying the resulting filaments. The filament can be cut into staples and then spun into yarn using conventional ring or open end rotor spinning techniques. However, rayon is not usually used in manufacturing Tee-shirts and similar articles of apparel because it is relatively higher in cost than cotton. In addition, fabric knitted from 100% rayon yarn appears to have a slick, shiny, synthetic look, which is undesirable to some consumers.

Thus, there remains a need for a yarn made of natural fibers that can be economically produced using conventional open end rotor spinning while, at the same time, has a good soft hand and drape, particularly after washing, that is comparable to ring spun 100% cotton and that minimizes undesirable fibrillation inherent in ring spun.

SUMMARY OF THE INVENTION

The present invention is directed to an apparatus for forming a cotton/rayon blended yarn. The apparatus includes a supply of cotton fibers and a supply of rayon fibers. A blending operation line blends the cotton fibers and the rayon fibers. The fibers are then spun in an open end spinning turbine having a twist multiple of less than about 3.7 at a rotor speed of less than about 112,000 RPM. A roughing navel downstream from the open end spinning turbine distresses the surface of the cotton/rayon blended yarn to further improve the hand of yarn. The yarn is then knitted and the fabric finished.

In the preferred embodiment, the finishing of the fabric includes a finishing range for applying a finishing mix composition to the fabric. The finishing mix composition includes a cationic polyethylene softener mixed with a silicone finish. The finishing range applies a wet pickup of the finishing mix composition of about 20 wt. % and between about 1-½ and 3 wt. % solids. A dryer for drying the fabric is downstream from the finishing range. The fabric is then taken up and subsequently cut and sewn into articles of apparel, such as Tee-shirts.

In the preferred embodiment, the staple length of the cotton fibers is between about ¾ and 1-½ inches with about 1-¼ inches being preferred. Preferably, the Micronaire value of the cotton fiber is less than about 4.

In the preferred embodiment, the staple length of the rayon fibers is also between about ¾ and 1-½ inches with about 1-¼ being preferred. The denier of the rayon fibers is less than about 1 with about 0.9 being preferred.

The blending operation line includes a blending feeder, a carding station, and a drawing station. The blending feeder combines the cotton fibers and the rayon fibers at a ratio of less than about 50% rayon with a ratio of cotton/rayon fibers of about 75/25 being preferred.

In the preferred embodiment, the twist multiple is about 3.2 and the rotor speed of the open end spinning turbine is between about 60,000 and 95,000 RPM with a rotor speed of the open end spinning turbine of about 95,000 RPM being preferred.

Yarn spun according to the present invention from a blend of cotton and rayon can be knitted or woven into fabric, and the resulting fabric, and apparel made therefrom, has the advantage of having a particularly soft and luxurious hand, particularly compared to fabric knit from 100% cotton yarn. Fabric knitted from the cotton/rayon blend of the present invention also has the advantage of retaining its softness and hand after washing. Cotton, in contrast, tends to become stiff and "board-like" after washing.

Yet another advantage associated with the fabric made from the yarn of the present invention is the improved drape of the fabric. Drape is a property associated with the aesthetic appearance of garments and other textile structures. Drape is the deformation of the fabric produced by gravity when only part of the garment or textile structure is directly supported. The drape of fabric made with the blend of cotton and rayon yarn of the present invention is better than fabric made of 100% cotton yarn, particularly after washing.

Accordingly, one aspect of the present invention is to provide an apparatus for forming a cotton/rayon blended yarn. The apparatus includes: a supply of cotton fibers; a supply of rayon fibers; a blending operation line for blending the cotton fibers and the rayon fibers; and an open end spinning turbine, wherein the open end spinning turbine uses a twist multiple of less than about 3.7 at a rotor speed of less than about 112,000 RPM.

Another aspect of the present invention is to provide an apparatus for forming a cotton/rayon blended yarn. The apparatus includes: an open end spinning turbine having a twist multiple of less than about 3.7 at a rotor speed of less than about 112,000 RPM; and a roughing navel downstream from the open and spinning turbine for distressing the surface of the cotton/rayon blended yarn.

Still another aspect of the present invention is to provide an apparatus for forming a cotton/rayon blended yarn. The apparatus includes: a supply of cotton fibers; a supply of rayon fibers; a blending operation line for blending the cotton fibers and the rayon fibers; an open end spinning turbine having a twist multiple of less than about 3.7 at a rotor speed of less than about 112,000 RPM; a roughing navel downstream from the open and spinning turbine for distressing the surface of the cotton/rayon blended yarn; and means for finishing a fabric formed from the blended yarn.

These and other aspects of the present invention will become apparent to those skilled in the art after a reading of the following description of the preferred embodiment when considered with the drawings.

DESCRIPTION OF THE PREFERRED EMBODIMENTS

Figure 1:
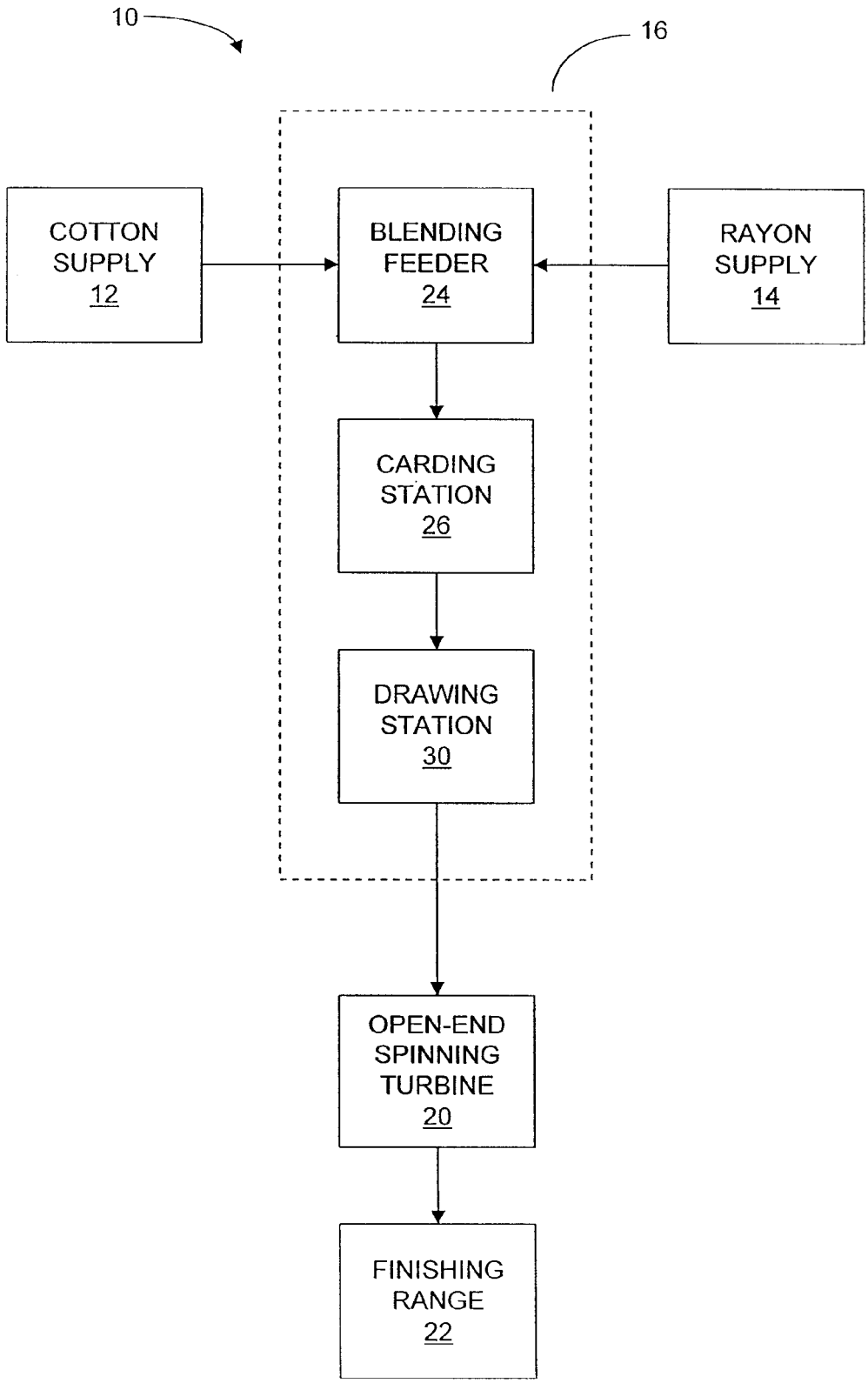
FIG. 1 is a schematic view of an apparatus for forming an open end spun, cotton/rayon blended yarn, constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

As best seen in FIG. 1, there is shown an apparatus for forming an open end spun, cotton/rayon blended yarn, generally designated 10, constructed according to the present invention. The apparatus includes a cotton fiber supply 12, a rayon fiber supply 14, a blending operation line 16 for intermixing the cotton and rayon fibers, and an open end spinning turbine 20 for forming the loose fibers into a yarn. The yarn may then be formed into a fabric, sent to a finishing range 22 and, eventually, into an article of apparel.

In the preferred embodiment, the blending operation line 16 includes a blending feeder 24, a carding station 26, and a drawing station 30. The staple length of the cotton fibers is between about ¾ and 1-½ inches with about 1-¼ inches being preferred. In addition, the Micronaire value of the cotton fiber is less than about 4. The staple length of the rayon fibers is between about ¾ and 1-½ inches with about 1-¼ inches also being preferred. In addition, the denier of the rayon fibers is less than about 1 with about 0.9 being preferred and available from Acordis Cellulosic Fibers of Axis, Alabama.

After the drawing station 30 completes its operation, the blended fibers are passed to the open end spinning station 20 and subsequently to the finishing operation 22. The resulting yarn can then be knitted into fabric, which can be sewn into articles of apparel, such as Tee-shirts.

The advantages of the present invention, when compared to ring spinning, air jet spinning, and conventional open end spinning can best be seen in the following table. The values are given on a 1–5 scale with 5 being best. The overall score is the product of the 3 values.

TABLE 1

| | Hand | Fibrillation | Spinning Productivity | Overall Score |
|---|---|---|---|---|
| Ring Spun | 4 | 1 | 2 | 8 |
| Air Jet Spun | 2 | 2 | 3 | 12 |
| Conventional Open End Spun | 1 | 3 | 3 | 9 |
| Present Invention | 4 | 3 | 3 | 36 |

As can be seen the present invention provides a fabric having comparable hand to ring spun yarn, no fibrillation, and is cost effective as conventional, open end spinning.

Initial trials also were conducted using various deniers of rayon fibers between 0.9 denier and 2.2 denier, and 1-½ inches rayon staple. These fibers were blended with staple cotton on a cotton/rayon ratio of 75/25. After blending and spinning, the yarn was knitted into a sock, finished, and measured for hand. As used herein, "hand" was measured with respect to the control sample of ring spun, 100% cotton to determine how "cotton-like" the material was. These results are shown in Table 2 to illustrate the effect of denier on hand. The values are given on a 1–5 scale with 5 being best. The control was ring spun 100% cotton.

TABLE 2

| Example | Denier | Staple Length | Hand |
|---|---|---|---|
| 1 | 2.2 | 1½" | 2 |
| 2 | 1.5 | 1½" | 2 |
| 3 | 1.1 | 1½" | 3 |
| 4 | 0.9 | 1½" | 4 |
| Control | | | 3 |

As can be seen, rayon fibers having a denier of about 1, and preferably about 0.9, have equal to or superior characteristics to the control sample of ring spun 100% cotton.

Additional tests were conducted on various cotton/rayon blends between 100% cotton as a control and 75/25, 63/37, and 50/50 cotton/rayon blends for staple lengths of 1-½ and 1-¼ inches. After spinning, these yarns were knit into socks, finished, and measured for hand.

TABLE 3

| Example | Blend Cotton/Rayon | Hand (1¼") | Hand (1½") |
|---|---|---|---|
| 5 | 50/50 | 3 | 2 |
| 6 | 63/37 | 3 | 2 |
| 7 | 75/25 | 4 | 3 |
| Control | 100 | 4 | 3 |

As can be seen from Table 3, the 75/25 cotton/rayon blend for either 1-¼ or 1-½ inch stable length rayon fibers have properties of hand similar to the control sample and, in addition, all of the blends between 75/25 and 50/50 cotton/rayon have similar properties for the 1-¼ inch staple rayon fibers. Thus, the 1-¼ inch staple rayon fibers appear to be the least adversely affected by variations in blend ratios.

Figure 2:
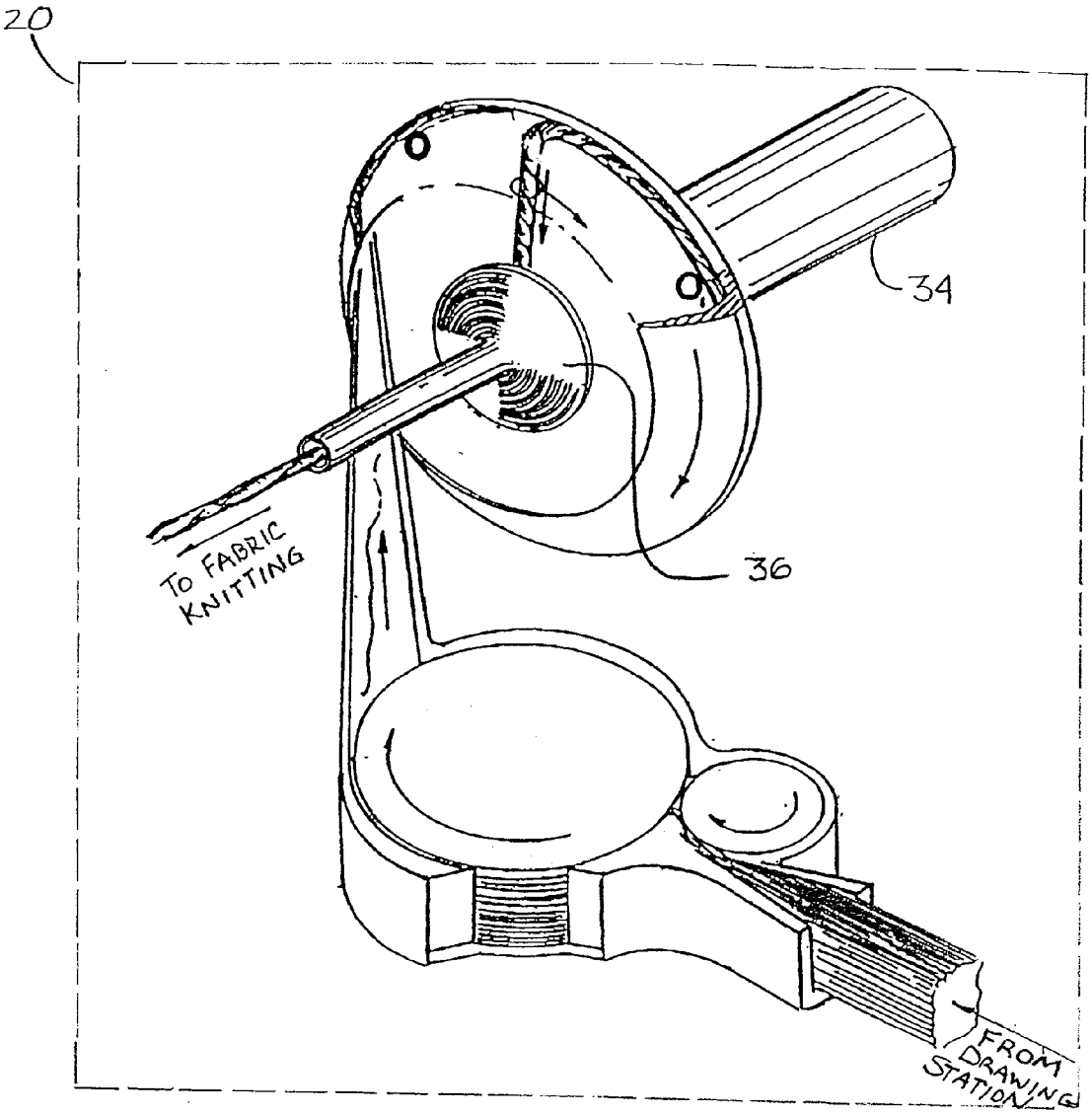
FIG. 2 is a schematic view of the fiber passing through the open end spinning station, including the open end spinning turbine and the downstream roughing navel.

Turning now to FIG. 2, there is shown a schematic view of the fiber being received from the drawing station 30 and passing through the open end spinning station 20 before going to the finishing station 22. In the preferred embodiment, the open end spinning station 20 includes an open end spinning turbine 34 and a roughing navel 36 downstream from the open end spinning turbine. Open end spinning is a well known textile process. One reference, which discusses it in some detail, is U.S. Pat. No. 4,698,956 to Clarke et al., the entire disclosure of which is hereby incorporated by reference. In the present invention, a preferred open end spinning turbine and roughing navel is a model K42L4 available from Schlafhorst, Inc. of Charlotte, N.C.

Additional samples of cotton/rayon blends were spun using the open end spinning turbine with and without the roughing navel to improve the hand and using twist multiples between 3.7 and about 3.2. In addition, the rotor speed was varied between about 112,000 RPM and 60,000 RPM. After blending and spinning, the yarn was knitted into a sock, finished, and measured for hand. These results are shown below to illustrate the effect of TM and rotor speed on hand (Table 4A) and on hairiness (Table 4B). The values in Table 4A are given on a 1–5 scale with 5 being best. The values in Table 4B are measured hairiness values. The control was ring spun 100% cotton.

TABLE 4A

| Example | TM | Rotor Speed | Relative Throughput | Hand (w/o navel) | Hand (w/navel) |
|---|---|---|---|---|---|
| 8 | 3.7 | 112K RPM | 100% | 1 | 2 |
| 9 | 3.5 | 95K RPM | 90% | 2 | 3 |
| 10 | 3.2 | 60K RPM | 60% | 3 | 4 |
| 11 | 3.2 | 95K RPM | 100% | 3 | 4 |

As can be seen, a satisfactory hand was obtained with the roughing navel if the twist multiple is reduced below about 3.7 and the rotor speed is reduced below about 112,000 RPM. However, this change adversely affects the throughput. For example, as the twist multiple is further reduced and the rotor speed is further reduced, throughput continues to drop, even though there is an improvement in hand, both with and without the roughing navel (see e.g., examples 9–10). However, as can be seen in Example 11, which is the preferred embodiment of the present invention, by raising the rotor speed somewhat while keeping the twist multiple at about 3.2, throughput can be increased without adversely affecting the hand.

TABLE 4B

| Example | TM | Rotor Speed | Relative Throughput | Hairiness (w/o navel) | Hairiness (w/navel) |
|---|---|---|---|---|---|
| 10 | 3.2 | 60K RPM | 60% | — | 9.9 |
| 11 | 3.2 | 95K RPM | 100% | 5.5 | 7.1 |
| 12 (calculated) | 3.2 | 75K RPM | 75% | | 8.5 |
| Control | 3.7 | 112K RPM | 100% | 9.1 | — |

As can be seen, a satisfactory hairiness was obtained with the roughing navel if the rotor speed is reduced below about 112,000 RPM. However, this change adversely affects the throughput. For example, as the rotor speed is further reduced, throughput continues to drop, even though there is an improvement in hairiness, both with and without the roughing navel. However, as can be seen in Example 12, which is the preferred embodiment of the present invention, by raising the rotor speed somewhat while keeping the twist multiple at about 3.2, throughput can be increased while, at the same time, obtaining a hairiness substantially equal to the control.

Figure 3:
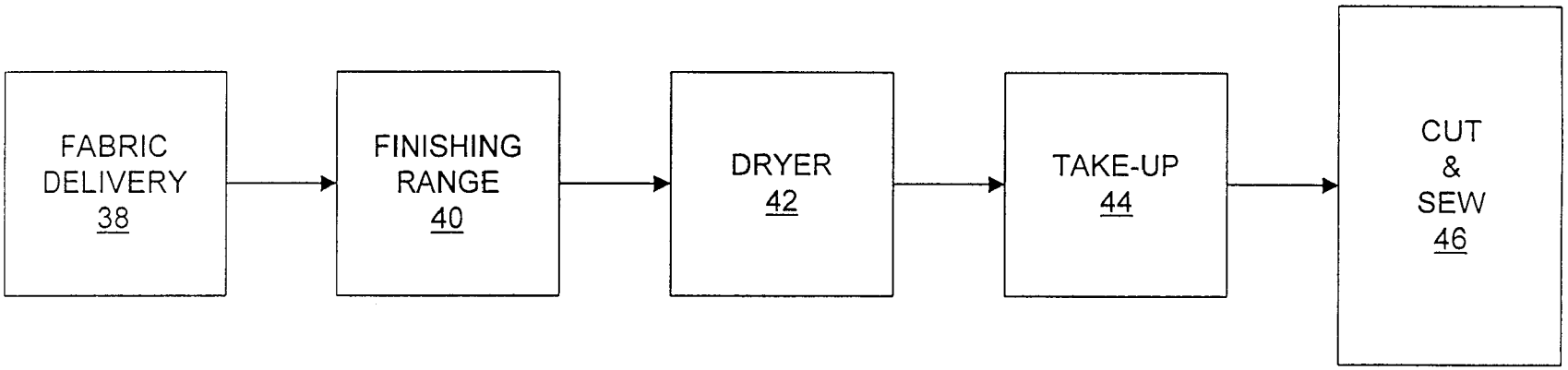
FIG. 3 is a schematic view of the fabric finishing range.

Finally, turning to FIG. 3, after the yarn has been spun in the open end spinning station 20, it is wound on a bobbin. The yarn can then be knitted into a fabric and the fabric finished in a conventional manner by passing the fabric from a fabric delivery 38 through a finishing range 40 where the finishing mix is applied. In the preferred embodiment, the finishing mix composition includes a cationic polyethylene softener mixed with a silicone finish. Preferably, the finishing range 40 applies a wet pickup of the finishing mix composition of about 20 wt. %. In the preferred embodiment, a dryer 42 for drying the fabric is downstream from the finishing range 40. The fabric then goes to a take-up 44 and subsequently to a cut and sew operation 46 where it is made into articles of apparel, such as Tee-shirts.

One such apparatus, which is particularly suitable for knitting the yarn into a fabric, is shown in U.S. Pat. No. 6,082,143 issued to Noonkester, which is commonly owned by the assignee of the present invention. The disclosure of this reference is hereby incorporated by reference in its entirety. The fabric is subsequently finished and cut and sewn into articles of apparel, such as Tee-shirts. The resulting garment, like the test samples shown in the tables above, has a comparable hand to ring spun, 100% cotton fabric while, at the same time, has both the reduced fibrillation (when compared to ring spinning) and productivity increase of open end spinning without the disadvantages of hand that are typical for conventional open end spinning. Specifically, the hand of the fabric is greater than the hand of a ring spun, 100% cotton yarn both before and after laundering. In addition, the extensibility value of the fabric is greater than a knitted fabric formed from a ring spun 100% cotton yarn. Extensibility is the ability of a material to undergo elongation on the application of force and is an indicator of how the fabric will move with body movement when worn.

Certain modifications and improvements will occur to those skilled in the art upon a reading of the foregoing description. By way of example, while the preferred embodiment to distress the surface of the blended yarn is a roughing navel, other devices may work as well. In addition, while equal length rayon fibers have been used in the preferred embodiment, variable length fibers may also work and have other advantages. Also, the fabric could be further mechanically or chemically treated during the fabric finishing process to further improve the hand of the fabric. It should be understood that all such modifications and improvements have been deleted herein for the sake of conciseness and readability but are properly within the scope of the following claims.

We claim:

1. An apparatus for forming a cotton/rayon blended yarn, said apparatus comprising:

(a) an open end spinning turbine having a twist multiple of less than about 3.7 at a rotor speed of less than about 112,000 RPM; and (b) a roughing navel downstream from said open end spinning turbine for distressing the surface of the cotton/rayon blended yarn.

2. The apparatus according to claim 1, wherein said twist multiple is about 3.2.

3. The apparatus according to claim 1, wherein the rotor speed of said open end spinning turbine is between about 60,000 and 95,000 RPM.

4. The apparatus according to claim 3, wherein the rotor speed of said open end spinning turbine is about 95,000 RPM.

5. The apparatus according to claim 4, wherein said twist multiple is about 3 2.

6. An apparatus for forming a cotton/rayon blended yarn, said apparatus comprising:

(a) a blending operation line for blending cotton fibers and rayon fibers;

(b) an open end spinning turbine having a twist multiple of less than about 3.7 at a rotor speed of less than about 112,000 RPM; and (c) a roughing navel downstream from said open end spinning turbine for distressing the surface of the cotton/rayon blended yarn.

7. The apparatus according to claim 6, wherein said blending operation line includes a blending feeder, a carding station, and a drawing station.

8. The apparatus according to claim 6, wherein said blending feeder combines said cotton fibers and said rayon fibers at a ratio of less than about 50% rayon.

9. The apparatus according to claim 8, wherein said ratio of cotton/rayon fibers is about 75/25.

10. The apparatus according to claim 6, wherein said twist multiple is about 3.2.

11. The apparatus according to claim 6, wherein the rotor speed of said open end spinning turbine is between about 60,000 and 95,000 RPM.

12. The apparatus according to claim 11, wherein the rotor speed of said open end spinning turbine is about 95,000 RPM.

13. The apparatus according to claim 12, wherein said twist multiple is about 3.2.

14. A method for forming a cotton/rayon blended yarn, said method comprising the steps of:

(a) blending cotton fibers and rayon fibers;

(b) open end spinning said blended cotton fibers and said rayon fibers using a twist multiple of less than about 3.7 at a rotor speed of less than about 112,000 RPM; and (c) distressing the surface of the cotton/rayon blended yarn after said blended yarns has been spun.

15. A method for forming a cotton/rayon blended yarn from a supply of cotton fibers and a supply of rayon fibers, said method comprising the steps of:

(a) open end spinning said blended cotton fibers and said rayon fibers using a twist multiple of less than about 3.7 at a rotor speed of less than about 112,000 RPM; and (b) distressing the surface of the cotton/rayon blended yarn after said blended yarn has been spun.

16. A method for forming a fabric from cotton/rayon blended yarn, said method comprising the steps of:

(a) blending cotton fibers and rayon fibers;

(b) open end spinning said blended cotton fibers and said rayon fibers using a twist multiple of less than about 3.7 at a rotor speed of less than about 112,000 RPM;

(c) distressing the surface of the cotton/rayon blended yarn after said blended yarn has been spun; and (d) forming a fabric from said blended yarn.

* * * * *